US005678499A

United States Patent [19]

Garcia-Mallol

[11] Patent Number: 5,678,499

[45] Date of Patent: Oct. 21, 1997

[54] SYSTEM FOR PREHEATING FUEL

[75] Inventor: Juan Antonio Garcia-Mallol, Morristown, N.J.

[73] Assignee: Foster Wheeler Energy Corporation, Clinton, N.J.

[21] Appl. No.: 497,918

[22] Filed: Jul. 3, 1995

[51] Int. Cl.[6] ..... F23D 1/00

[52] U.S. Cl. ..... 110/347; 110/261; 110/265; 110/104 B

[58] Field of Search ..... 110/104 B, 261–265, 110/347; 431/161, 166, 177, 183

[56] References Cited

U.S. PATENT DOCUMENTS

| | | | |
|---|---|---|---|
| 4,479,442 | 10/1984 | Itse et al. | 110/264 X |
| 4,602,571 | 7/1986 | Chadshay | 110/265 X |
| 4,718,359 | 1/1988 | Skoog | 110/264 |
| 4,930,430 | 6/1990 | Allen et al. | 110/264 |
| 5,101,633 | 4/1992 | Keller et al. . | |
| 5,107,776 | 4/1992 | Garcia-Mallol | 110/264 |
| 5,199,355 | 4/1993 | Larue | 110/261 |
| 5,199,357 | 4/1993 | Garcia-Mallol | 110/347 |
| 5,231,937 | 8/1993 | Kobayashi et al. | 110/265 X |

*Primary Examiner*—Henry A. Bennett
*Assistant Examiner*—Susanne C. Tinker
*Attorney, Agent, or Firm*—Haynes and Boone, L.L.P.

[57] ABSTRACT

A system and method for preheating a mixture of fuel and air as the mixture is introduced into a furnace combustion chamber comprises passing the mixture through a nozzle extending into an upstream portion of an opening defined in a wall enclosing the combustion chamber. The nozzle is sized so that an annular space is formed between the nozzle and the opening. Hot air is introduced through the annular space and mixes with and preheats, in a downstream portion of the opening, the mixture passing through the nozzle. The preheated mixture then passes into the furnace combustion chamber for combustion therein.

23 Claims, 2 Drawing Sheets

SYSTEM FOR PREHEATING FUEL

BACKGROUND OF THE INVENTION

This invention relates to a system and method for combusting fuel in a furnace and, more particularly, to such a system and method having a fuel nozzle arranged for preheating a fuel such as pulverized coal just before the fuel is injected into the furnace and combusted therein.

Pulverized coal furnaces are well-known. In these structures, fuels, such as coal and coke, which were first pulverized into a particulate state, are then injected through a burner fuel injection nozzle into a combustion chamber in the furnace, and finally ignited and burned to produce heat. Nozzles conventionally utilized in such furnaces extend through a furnace wall opening to the boundary of the combustion chamber, which opening is commonly lined with a sleeve. There are three general types of systems designed to perform these operations: direct systems, indirect systems, and semi-direct systems.

In accordance with direct systems, the fuel is pulverized in a mill and then delivered to the furnace suspended in air. It is common in such systems, to use the same air, commonly referred to as "primary air," to mix in the mill with the fuel, dry it, and transport it "directly" to and through the fuel injection nozzle and into the furnace combustion chamber. A disadvantage of using primary air is that it is relatively cool and moist and therefore retards the ignition of the fuel in the furnace. To resolve this problem with hard-to-ignite fuels, the fuel-air mixture is commonly passed through a dust collector, such as the cyclone separator described in U.S. Pat. No. 5,107,776 to Garcia-Mallol, incorporated herein fully by reference, which vents most of the cool primary air elsewhere into the furnace and, as a result, decreases the primary air-to-fuel ratio of the mixture being injected into the combustion chamber. The air-to-fuel ratio is then brought back up, by introducing into the mixture a substantial amount of relatively hot dry air directed through an annulus formed between the fuel injection nozzle and the sleeve in the furnace wall opening. This so-called "sleeve air" can be controlled to increase the combustion efficiency of the fuel. The disadvantage with this method is that there is insufficient time for the hot air to preheat the fuel-air mixture before the latter enters the furnace.

Like direct systems, indirect systems use pulverized coal. However, unlike direct systems, indirect systems require storing pulverized coal in a hopper until it is ready to be used, after which it is transported to the burner and injected into the furnace as needed. Semi-direct systems are similar to indirect systems except that the pulverized coal is stored in a dipleg joining a cyclone separator to the combustion chamber. There are several disadvantages associated with using either the indirect or the semi-direct systems. For example, there is a total separation of pressurized pulverizing (mill) air from the coal fuel, resulting in a loss of air pressure. There is also a need for additional parts such as pneumatic transfer lines, moving rotary valves, and associated seals which require maintenance and increase the likelihood of having unplanned, as well as planned, shutdowns. The risk of spontaneous combustion, explosion, or fire is also increased when pulverized coal is stored rather than transported directly to a furnace.

SUMMARY OF THE INVENTION

It is therefore an object of the present invention to provide a system in which a mixture of fuel and air is preheated just before it enters the combustion chamber of a furnace.

It is a further object of the present invention to provide a system of the above type in which the number of parts, including moving parts, and the risk of explosion and fire are minimized.

It is a further object of the present invention to provide a system of the above type in which fuel is pulverized and then delivered directly to a cyclone burner suspended in primary air.

It is a further object of the present invention to provide a system of the above type in which the cyclone burner includes a nozzle recessed within a furnace wall inlet opening away from the combustion chamber, the nozzle being sized such that an annulus is defined between the nozzle and the opening.

It is a further object of the present invention to provide a system of the above type in which a stream of hot air passes through the annulus formed between the burner nozzle and the inlet opening and mixes with and preheats the fuel and air mixture just before the mixture is introduced into the combustion chamber of the furnace.

It is a further object of the present invention to provide a burner nozzle of the above type in which a core member is disposed within the nozzle to improve mixing and preheating efficiency and to maintain the momentum of the mixture as it enters into the combustion chamber of the furnace.

Towards the fulfillment of these and other objects, the system and method of the present invention feature a furnace having a wall enclosing a combustion chamber, which wall includes an opening for passing a mixture of fuel and air therethrough into the combustion chamber. A burner nozzle is disposed in an upstream portion of the opening and is sized so that a first annular space is formed between the outside wall of the nozzle and the inside wall of the upstream portion of the opening. A core member is mounted in the nozzle so that a second annular space is defined between the core member and the inside wall of the nozzle. The core member extends from the nozzle into a downstream portion of the opening so that a third annular space is defined between the core member and the inside wall of the downstream portion of the opening. The fuel/air mixture passes through the second annular space and, concurrently, a stream of hot air passes through the first annular space, which hot air then combines with and preheats the fuel/air mixture in the third annular space, which preheated mixture then enters the combustion chamber for combustion therein.

BRIEF DESCRIPTION OF THE DRAWINGS

The above brief description, as well as further objects, features and advantages of the method of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
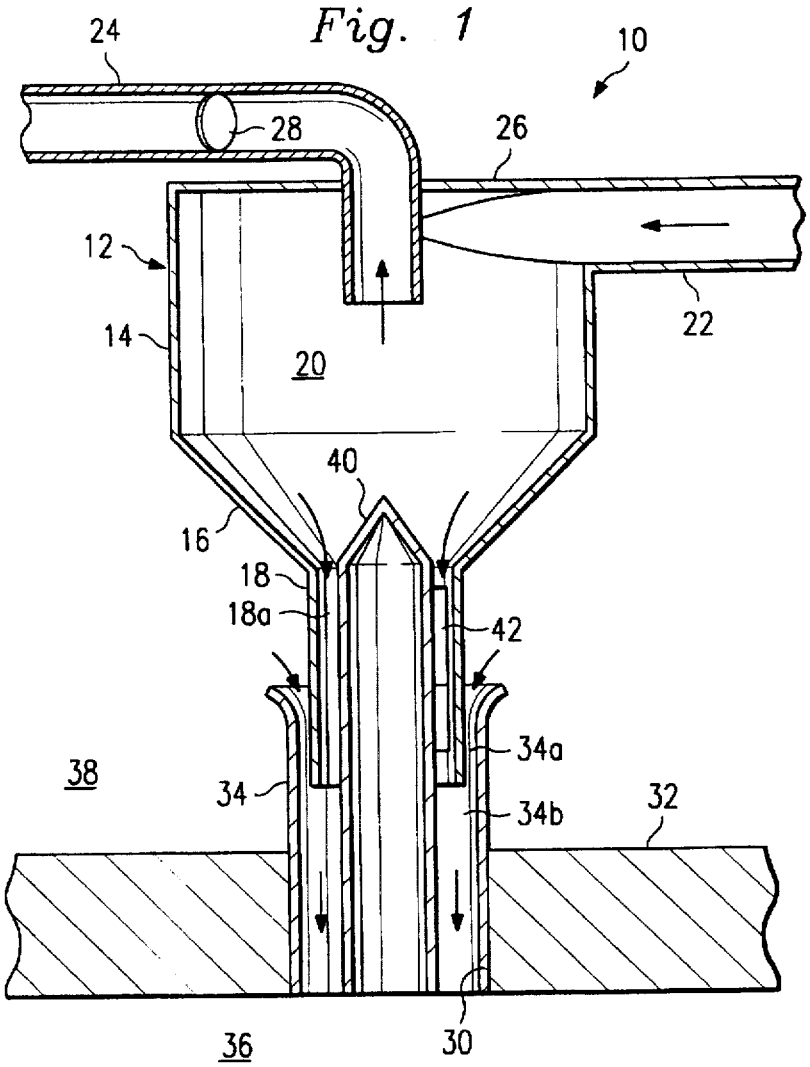
FIG. 1 is a cross-sectional view depicting a first preferred embodiment of a fuel preheating system of the present invention.

Referring to the FIG. 1, the reference numeral 10 refers, in general, to a cyclone burner assembly of the present invention, which burner assembly is adapted for use with a "direct" coal-firing system. As exemplified in U.S. Pat. No. 5,107,776 to Garcia-Mallol, the burner 10 includes a typical housing 12 formed by a cylindrical outer barrel 14, a hollow frusto-cone 16 and a cylindrical injection nozzle 18. The barrel 14 extends from the base of the cone 16, and the nozzle 18 extends from the frustum of the cone 16 to form a hollow, integral and continuous structure defining a cavity 20. An inlet conduit 22 extends through a wall in the barrel 14 in a tangential relationship to the barrel 14. A primary air vent 24 extends axially through an end plate 26 which caps the barrel 14. A vent damper 28 is suitably mounted in the air vent 24.

The burner 10 is disposed above an inlet opening 30 in a furnace arch wall 32 as is more fully described below. A bellmouth sleeve 34 is disposed in the inlet opening 30. Although not clear from the drawings, it is understood that the wall 32, together with other structures and walls (not shown), define a combustion chamber positioned just below the inlet opening 30 as viewed in FIG. 1, a portion of which is referred to by the reference numeral 36. As viewed in FIG. 1, the wall 32 is generally horizontal, the combustion chamber 36 extends downwardly from the wall 32 and the burner 10 extends upwardly from and exterior to the combustion chamber. So situated, the burner 10 injects a mixture of particulate fuel and primary air downwardly into the combustion chamber 36 as is more fully described below. It is understood, however, that the burner 10 could also be mounted on a vertical wall or on any angled wall. It is further understood that the wall 32, together with other structures and walls (not shown) extending upwardly therefrom, define a windbox which encloses the burner 10 as viewed in FIG. 1, a portion of which is referred to by the reference numeral 38.

The structure thus far described is generally known. According to the present invention, the nozzle 18 of the burner 10 extends only into an upstream portion of the sleeve 34. The outside diameter of the nozzle 18 is slightly less than the inside diameter of the sleeve 34 to define, in the upstream portion of the sleeve, an annular space **34*a*** between the nozzle and the sleeve.

The nozzle 18 is provided with a core member 40 which is axially mounted within the nozzle and which extends downwardly into a downstream portion of the sleeve 34 to the boundary of the furnace as shown in FIG. 1. The core 40 is substantially hollow, and is sealed at its upper end with a conical cap. The outside diameter of the core 40 is sized so that a annular space **18*a* is formed between the core and the nozzle 18, and so that an annular space 34*b* is formed between the core and the downstream portion of the sleeve 34. Three spaced, longitudinal, radially extending straightening vanes 42 (one of which is shown) are secured to the core 40 within the annular space 18*a*. It is understood that the core member 40** could be longitudinally slidable or extendable; however, for the sake of brevity, such a core will not be described herein since it is described in detail in the above-mentioned '776 patent to Garcia-Mallol.

In operation, a mixture of particulate fuel and primary air is introduced into the conduit 22 from a coal pulverizing mill with primary air carrying the particulate fuel into the barrel 14. Due to the momentum of the particulate fuel and the tangential alignment of the conduit 22 to the barrel 14, the mixture is separated into a fuel-rich portion which swifts around within the cavity 20 and is propelled by centrifugal force against the inner wall of the barrel 14 leaving a fuel-deficient, air rich portion in the center of the cavity 20. The flow of primary air propels the fuel-rich portion of the mixture downwardly along the inner wall of the cone 16 and the inner wall of the nozzle 18 and then out through the annular space **34*b* into the combustion chamber 36. The core 40 helps to maintain the downward momentum of the fuel-rich portion of the mixture and, furthermore, restrains at least a portion of the air-rich portion of the mixture in the center of the cavity 20 from passing through the nozzle 18. To maintain optimal combustion efficiency, the vent damper 28 can be adjusted to bleed off, via the primary air vent 24, a portion of the air-rich portion of the mixture in the center of the cavity 20 until the primary air-to-fuel ratio is at an optimal level. The portion of the air-rich portion of the mixture not bled off through the vent 24 flows through the nozzle 18 and the annular space 34*b* into the combustion chamber 36. Relatively hot "sleeve air" flows from the windbox 38 through the annular space 34*a* and into the annular space 34*b* where it then mixes with and preheats the fuel-air mixture from the nozzle 18 just before the mixture enters the combustion chamber 36**.

In an illustrative example, the outside diameter of the core 40 is 8 inches, the inside diameter of the nozzle 18 is 10.75 inches, and the inside diameter of the sleeve 34 is 13.5 inches. Furthermore, the fuel and air mixture received in the cyclone 10 passes through the annular space **18*a* at 40 feet per second, has a temperature of 250° F., and has an air-to-coal (A/C) ratio of 0.33. The air in the windbox passes through the annular space 34*a* at 150 feet per second with a temperature of 650° F. The annular space 34*a* is approximately 7.5 inches long, and the annular spaces 18*a* and 34*b* are each approximately 14.5 inches long. Given the foregoing dimensions and operating parameters, the stream mixing (residence) time in the annular space 34*b* is approximately 0.01 seconds, during which time a mixture temperature of 400° F. and an A/C ratio of 1.2 is attained before the mixture enters the combustion chamber 36**. It is understood that the dimensions and operating parameters specified herein are provided for illustration purposes and may vary with a particular design.

The invention disclosed in the foregoing description results in many advantages over indirect and semi-direct systems. For example, since the "direct" system is incorporated, there are no moving parts and therefore maintenance is minimized. Also, air may be pressurized using less power than is required by indirect or semi-direct systems. Moreover, fuel preheating comparable to or better than either semi-direct or indirect firing systems is achieved more economically, in less time, and with less risk of explosions and fires than is possible with either semi-direct or indirect firing systems.

The present invention also has many advantages over conventional direct systems. For example, the formation of the annular space **34*b* by recessing the nozzle 18 and extending the core member 40 into the downstream portion of the sleeve 34, enhances the mixing of the fuel and hot air and the pre-heating efficiency thereof. The straightening vanes 42 more evenly distribute the flow of the fuel-air mixture into the annular space 34*b*, thereby further enhancing the mixing and the pre-heating efficiency thereof. As a consequence of the foregoing enhancements, low-grade fuel may be utilized, flame stability may be increased, and according to conservative calculations, over 60% of the fuel particles may be heated up to said mixture temperature in said residence time and, thus, ignite more readily in the combustion chamber 36** and, furthermore, improve the ignition of the remaining fuel particles in the combustion chamber. Finally, the present invention may also be retrofitted onto existing direct systems.

It is understood that several variations may be made in the foregoing without departing from the scope of the present invention. For example, the burner 10 need not be a cyclone burner, but rather may be an ordinary primary burner. The core 40 need not be hollow but may be formed from a solid cylinder. In fact, the core need not be included in the system at all or, alternatively, it could be included as single or multiple longitudinally slidable sleeves as described in the aforementioned patent '776 to Garcia-Mallol to improve control of the A/C ratio. The number of straightening vanes 42 may also vary from three and may be reduced to zero.

Figure 4:
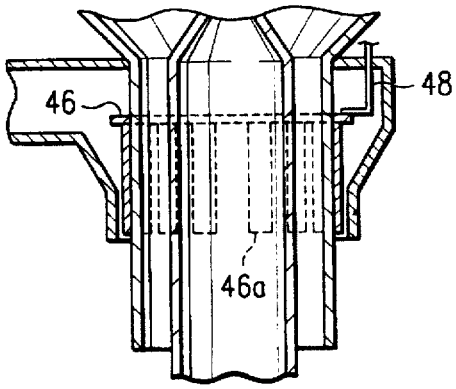
FIG. 4 is a cross-sectional view depicting a portion of a fourth preferred embodiment of a fuel preheating system of the present invention.
Figure 5:
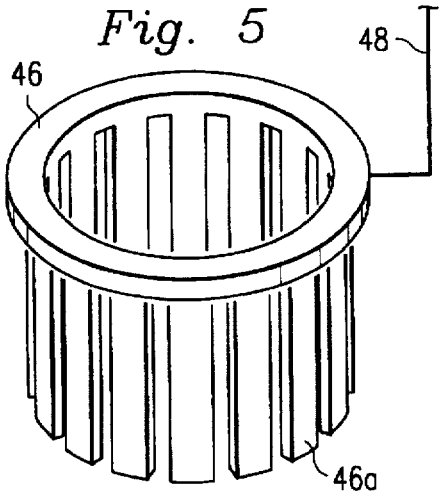
FIG. 5 is a perspective view of a support ring utilized in the fuel preheating system of the fourth embodiment of FIG. 4.
Figure 2:
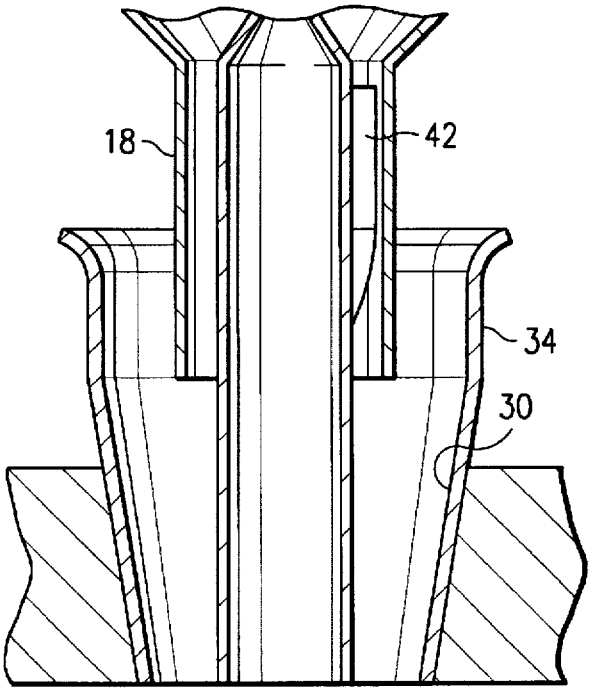
FIG. 2 is a cross-sectional view depicting a portion of a second preferred embodiment of a fuel preheating system of the present invention.
Figure 3:
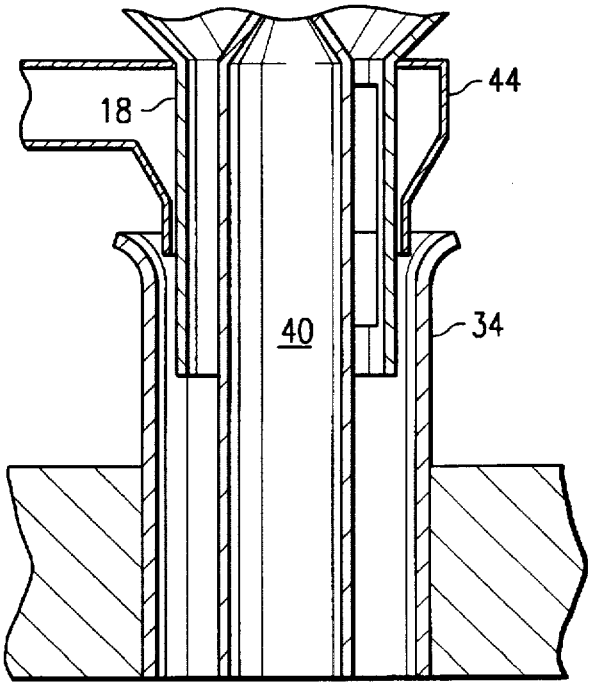
FIG. 3 is a cross-sectional view depicting a portion of a third preferred embodiment of a fuel preheating system of the present invention.

FIGS. 2, 3, and 4 depict the details of a burner nozzle 10 disposed in an inlet 30 of a furnace wall 32 according to respective second, third, and fourth preferred embodiments of the present invention. Since the cyclone burner 10 contains many components that are identical to those of the first embodiment, these components are referred to by the same reference numerals and therefore will not be described in any greater detail.

According to the second embodiment shown in FIG. 2, the sleeve 34 is provided with a generally frustoconical configuration which converges toward the combustion chamber 36. Furthermore, the lower portion of the vanes 42 are angularly inclined such that they spiral downwardly about the core member 40.

In addition to the advantages enumerated above with respect to the first embodiment, additional advantages result from the second embodiment. For example, the frustoconical sleeve 34 restricts the flow into the combustion chamber 36, in the downstream portion **34*b* of the sleeve 34, to maintain high momentum in the air. As a further result, the fuel mixes more thoroughly with the hot air from the windbox 38, and is thereby preheated before it enters the combustion chamber 36 so that it may be more readily ignited therein. The spiral portion of the vanes 42 yield similar advantages because the spiral shape reduces the downward velocity of the fuel particles, thereby increasing the residence time for mixing and preheating of the fuel in the downstream portion 34*b* of the sleeve 34**.

According to the third embodiment shown in FIG. 3, a conduit 44 is provided for supplying hot air from a main air supply header at the coal pulverizing mill. The terminus of the conduit 44 envelopes the circumference of the nozzle 18 and opens downwardly as shown in FIG. 3 to direct high-pressure hot air flowing from the conduit downwardly adjacent the outer wall of the nozzle into the opening 30. In addition to the advantages discussed above relating to the first embodiment, the high-pressure air flowing downwardly from the terminus of the conduit 44 entrains additional air from the windbox 38 into the annular space **34*a*, and improves mixing and preheating of fuel in the downstream portion 34*b* of the sleeve 34 before the fuel enters the combustion chamber 36**.

According to the fourth embodiment shown in FIG. 4, a support ring 46 is provided with an array of parallel finger projections **46*a* which depend from the ring and extend to form a cylindrical shape. The ring 46 is sized to slidingly fit within the downwardly facing opening formed by the terminus of the conduit 44 about the nozzle 18 (FIG. 3). A control rod 48 is attached to the ring 46 for raising and lowering the ring therein. In addition to the advantages discussed above relating to the third embodiment, the fourth embodiment provides for control of the flow of hot, high-pressure air from the main air supply conduit 44 into the inlet 30. Furthermore, for a given quantity of air flowing downwardly from the conduit 44, restriction of the air passage between the nozzle 18 and the sleeve 34 by the ring 46 and finger projections 46*a*** helps to maintain high momentum in the air flowing downwardly from the conduit.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A method for introducing fuel through an inlet opening extending through a wall defining a portion of a furnace combustion chamber, said inlet opening having upstream and downstream portions, said method comprising:

receiving a mixture of fuel and air;

directing said mixture through said upstream portion of said inlet opening to and through said downstream portion of said inlet opening to said chamber; and supplying additional air to said downstream portion of said inlet opening so that said additional air mixes with and preheats said mixture in said downstream portion before said mixture enters said chamber; and injecting air into said downstream portion of said inlet opening to facilitate the mixing and preheating of said additional air and said mixture in said downstream portion.

2. The method of claim 1 further comprising increasing the momentum of said mixture and said additional air in said downstream portion of said inlet opening by fitting said inlet opening with a substantially frustoconical sleeve which converges toward said combustion chamber.

3. The method of claim 1 further comprising directing said mixture through longitudinally disposed vanes to distribute said mixture.

4. The method of claim 3 further comprising forming a portion of said vanes in a spiral, thereby reducing the downward velocity of said fuel and increasing the residence time of said mixture in said downstream portion of said inlet opening.

5. A system for introducing fuel through an inlet opening extending through a wall defining a portion of a furnace combustion chamber, said inlet opening having upstream and downstream portions, said system comprising:

means for receiving a mixture of fuel and air;

a nozzle associated with said receiving means, extending longitudinally into said upstream portion of said inlet opening, for directing said mixture from said receiving means to and through said downstream portion of said inlet opening to said chamber, said nozzle being sized and disposed so that an annular space is defined between said nozzle and that portion of said wall defining said upstream portion of said inlet opening;

means for supplying additional air through said annular space into said downstream portion of said inlet opening so that said additional air mixes with and preheats said mixture in said downstream portion of said inlet opening before said mixture enters said chamber; and means for injecting air through said annular space into said downstream portion to facilitate the mixing and preheating of said additional air and said mixture in said downstream portion of said inlet opening.

6. The system of claim 5 further comprising a substantially cylindrical core member axially mounted within said nozzle and extending into said downstream portion of said inlet opening, said core being sized smaller than said nozzle so that said mixture from said receiving means can pass between said nozzle and said core to said downstream portion of said inlet opening.

7. The system of claim 6 wherein said core is longitudinally slidable to control the amount of air that passes therethrough.

8. The system of claim 5 further comprising a sleeve fitted into said inlet opening, said sleeve having upstream and downstream portions.

9. The system of claim 8 wherein the upstream portion of said sleeve includes a bellmouth opening.

10. The system of claim 8 wherein said sleeve is defined by a generally frustoconical configuration which converges toward said combustion chamber.

11. The system of claim 5 wherein said supplying means comprises a windbox.

12. The system of claim 5 wherein said receiving means comprises a burner assembly.

13. The system of claim 5 wherein said receiving means comprises a cyclone burner assembly.

14. The system of claim 5 wherein said injecting means includes a conduit having a terminus which envelopes the outer circumference of said nozzle, and wherein said terminus includes an outlet opening for directing air from said conduit in a downstream direction adjacent the outer wall of said nozzle and through said annular space.

15. The system of claim 5 further comprising a ring having longitudinally extending projections, and means for sliding said ring into said outlet opening, thereby controlling said flow of said air from said terminus through said outlet opening.

16. The system of claim 5 further comprising longitudinally disposed vanes in said nozzle for distributing the flow of said mixture therethrough.

17. The system of claim 16 wherein a portion of said vanes spiral toward said chamber to reduce the downward velocity of said fuel and increase the residence time of said fuel in said downstream portion of said inlet opening.

18. A system for introducing fuel through an inlet opening extending through a wall defining a portion of a furnace combustion chamber, said system comprising:

a sleeve for lining said inlet opening, said sleeve having upstream and downstream portions;

a cyclone burner for receiving a mixture of fuel and air;

a nozzle, associated with said burner, extending longitudinally into said upstream portion of said sleeve, for directing said mixture from said cyclone to and through said downstream portion of said sleeve to said chamber, said nozzle being sized and positioned so that an annular space is defined between said nozzle and said sleeve;

a substantially cylindrical core member axially mounted within said nozzle and extending into said downstream portion of said sleeve, said core being sized smaller than said nozzle so that said mixture from said burner can pass between said nozzle and said core to said downstream portion of said sleeve;

a windbox, enclosing said burner, for supplying additional air through said annular space into said downstream portion of said sleeve so that said additional air mixes with and preheats said mixture in said downstream portion of said sleeve before said mixture enters said chamber; and a conduit having a terminus which envelopes the outer circumference of said nozzle, said terminus defining an outlet opening for directing air from said conduit in a downstream direction adjacent the outer wall of said nozzle into said annular space to facilitate the mixing of said air and said fuel in said downstream portion of said sleeve.

19. The system of claim 18 wherein the upstream portion of said sleeve includes a bellmouth opening.

20. The system of claim 18 wherein a portion of said sleeve is defined by a generally frustoconical configuration which converges toward said combustion chamber.

21. The system of claim 18 further comprising a ring having longitudinally extending projections, and means for sliding said ring into said outlet opening, thereby controlling said flow of said air from said terminus.

22. The system of claim 18 further comprising longitudinally disposed vanes secured to said core member for distributing the flow of said mixture therethrough.

23. The system of claim 22 wherein a portion of said vanes spiral toward said chamber to reduce the velocity of said fuel and increase the residence time of said fuel in said downstream portion of said inlet opening.

* * * * *

UNITED STATES PATENT AND TRADEMARK OFFICE

CERTIFICATE OF CORRECTION

PATENT NO. : 5,678,499

DATED : October 21, 1997

INVENTOR(S) : Juan Antonio Garcia-Mallol

It is certified that error appears in the above-identified patent and that said Letters Patent is hereby corrected as shown below:

Column 4, line 4, "swifts" should be --swirls--.

Signed and Sealed this

Twenty-fourth Day of February, 1998

*Attest:*

Bruce Lehman

BRUCE LEHMAN

*Attesting Officer*

*Commissioner of Patents and Trademarks*